US005929742A

United States Patent [19]

Short

[11] Patent Number: 5,929,742

[45] Date of Patent: Jul. 27, 1999

[54] TRIP-FREE, MANUAL RESET THERMOSTAT

[75] Inventor: Stephen P. Short, North Situate, R.I.

[73] Assignee: Elmwood Sensors, Inc., Pawtucket, R.I.

[21] Appl. No.: 08/825,097

[22] Filed: Mar. 27, 1997

[51] Int. Cl.[6] ..... H01H 37/70; H01H 37/74; H01H 37/54

[52] U.S. Cl. ..... 337/348; 337/343; 337/327; 337/358; 337/365; 337/367

[58] Field of Search ..... 337/348, 74, 367, 337/354, 342, 334, 56, 358, 356, 349, 91, 343, 327, 365

[56] References Cited

U.S. PATENT DOCUMENTS

| | | | |
|---|---|---|---|
| 3,081,388 | 3/1963 | Cox . | |
| 3,219,783 | 11/1965 | Odson . | |
| 3,525,968 | 8/1970 | Hire . | |
| 3,621,434 | 11/1971 | Gerich . | |
| 3,781,744 | 12/1973 | Olson | 337/118 |
| 3,832,667 | 8/1974 | Blanton . | |
| 3,924,213 | 12/1975 | Semple | 337/130 |
| 4,039,991 | 8/1977 | Bucheister . | |
| 4,349,806 | 9/1982 | Boulanger . | |
| 4,480,246 | 10/1984 | Schmitt | 337/348 |
| 4,952,901 | 8/1990 | Chrupcala et al. | 337/372 |
| 5,003,282 | 3/1991 | Boulanger . | |
| 5,157,370 | 10/1992 | Engelbach et al. . | |
| 5,270,799 | 12/1993 | Rose | 337/354 |

*Primary Examiner*—Leo P. Picard
*Assistant Examiner*—Anatoly Vortman
*Attorney, Agent, or Firm*—Salter & Michaelson

[57] ABSTRACT

A thermostat includes a housing having a cavity formed therein, a temperature responsive bimetallic disc located in the housing, a stationary contact member which is electrically interconnected to a first terminal external to the housing, and a movable contact member which is electrically interconnected to a second terminal external to the housing. The movable contact member movable between a switch-closed position and a switch-open position. An actuating member is located in the housing and is responsive to flexing movement of the disc for moving the movable contact member from the switch-closed position to the switch-open position. A reset assembly is provided for resetting the disc, and includes a reset element which is movable between a first position in which it is spaced from the actuating member and a second position in which it is axially moved to engage the actuating member for moving the disc back to its pre-flexed position. The reset assembly further includes a rocker element engageable with the movable contact member for maintaining the movable contact member in its switch-open position while the reset element is in its second position.

6 Claims, 5 Drawing Sheets

TRIP-FREE, MANUAL RESET THERMOSTAT

BACKGROUND OF THE INVENTION

This invention relates generally to thermostatic switches, and more particularly to a thermostat having a uniquely constructed trip free, manual reset feature.

The thermostat of the present invention is designed to be used in appliances, photocopying machines, computers, and the like. Most thermostats presently available for such use are capable of being reset, and typically include a manually operable plunger that is engageable with an actuating member which is in turn engageable with a bimetallic disc. Bimetallic discs are well-known in the art of thermostatic switches and are designed to flex or move when the environment in which the thermostat is placed reaches a predetermined temperature. In prior thermostats, resetting of the circuit in the thermostat was accomplished by pressing a reset element in the thermostat to move the actuating member into engagement with the disc and completing the circuit.

One problem associated with these types of thermostats is that often it is not desirable to return the movable contact member to the closed position and establish electrical communication through the thermostat until the disc has returned to its original (or switch-closed) configuration. More specifically, in instances where the temperature does not go below the predetermined temperature, the movable contact member is prematurely returned to the switch-closed position which in some instances results in malfunction of the thermostat or other temperature-related hazard. Oftentimes it is desirable to open or close an electric circuit and retain it in such condition until the thermostat is manually reset and only after the temperature has returned to an acceptable level (i.e., below the predetermined temperature).

Several thermostats have been designed to address this problem. One such thermostat is disclosed in U.S. Pat. No. 4,039,991 to Bucheister, which is assigned to the assignee of the present application. This patent discloses a thermostat having a lock device that is engageable with a movable contact member in the switch-open position. The lock device comprises a spring lever which overlies the contact member and is secured to the housing by a rivet. A latch finger having an inclined surface defining a notch is attached to the spring lever. The notch is located so that the latch finger engages the contact member for retaining and maintaining the contact member in a switch-open position upon the bimetallic disc flexing in response to increased temperature.

It should be noted that the reset feature of Bucheister's thermostat, while sufficiently suitable from a performance standpoint, is relatively complex in design and expensive to manufacture. This is due to the additional component parts required to achieve the lock device, i.e., the spring lever, rivet, and latch finger, and the additional assembly time.

"Trip free" thermostats are also well-known in the art. Reference is made to U.S. Pat. Nos. 3,621,434 to Gerich, 3,832,667 to Blanton, 5,003,282 to Boulanger, and 5,157,370 to Engelbach et al. as representative prior art disclosing trip free thermostats. In this regard, the Boulanger patent is most pertinent reference in the art of the present invention. Boulanger discloses a thermostat having a housing with a push button extending axially through an opening formed on one end of the housing. Two normally closed contacts are disposed within the housing, one of the contacts being stationary while the other contact is movable on a spring-biased arm. Boulanger further provides a bimetallic disc on the other end of the housing, the disc flexing inwardly when the thermostat is subject to a temperature higher than a predetermined temperature. A spring is disposed between the disc and the arm, and, when the thermostat is subject to a temperature higher than the predetermined temperature, the spring moves the arm so as to disengage the contacts.

To reset Boulanger's thermostat, the push button is moved toward the disc which rotates the spring member about a pivot, thereby resetting the disc and pushing the end portion of the spring against the arm having the movable contact to maintain the contacts open. The contacts remain open until the push button is released which allows the spring to rotate away from the carrier which in turn allows the contacts to engage one another once again.

One disadvantage associated with Boulanger's approach is that it is relatively complicated in design since there are two springs which require precise machining and calibration in order to perform properly. This complicacy results in the thermostat being relatively expensive to manufacture, and difficult to assembly since the springs require exact placement within the housing.

SUMMARY OF THE INVENTION

In general, the present invention is directed to a thermostat comprising a housing having a cavity formed therein, and a temperature responsive bimetallic disc located in the housing and responsive to a predetermined temperature for exerting a flexing action. A stationary contact member is located in the cavity, the stationary contact member being electrically interconnected to a first terminal external to the housing. A movable contact member is also located in the cavity adjacent the stationary contact member, the movable contact member being electrically interconnected to a second terminal external to the housing. Moreover, the movable contact member is biased and movable between a switch-closed position in which it makes electrical contact with the stationary contact member and a switch-open position in which it is spaced from the stationary contact member. An actuating member is located in the housing and is responsive to flexing movement of the disc for moving the movable contact member from the switch-closed position to the switch-open position.

A reset assembly of the present invention is provided for resetting the disc. The reset assembly comprises a reset element which is movable between a first position in which it is spaced from the actuating member and a second position in which it is axially moved to engage the actuating member for moving the disc back to its pre-flexed position. The reset assembly further comprises a rocker element engageable with the movable contact member for maintaining the movable contact member in its switch-open position while the reset element is in its second position.

Accordingly, among the several objects of the present invention are: the provision of an improved trip free, manual reset thermostat which cannot be overridden manually, even if a reset button thereof is held in place for a period of time; the provision of such an improved thermostat which only resets after the reset button has been released; the provision of such an improved thermostat which is comprised of relatively few component parts and is easy to assemble; the provision of such an improved thermostat which returns to a switch-closed position only after a bimetallic disc of the thermostat has flexed to the switch-closed position in response to the temperature returning to an acceptable level; the provision of such an improved thermostat which is sturdy in construction and durable in use; and the provision of such an improved thermostat which is cost-efficient to manufacture.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENT

Figure 1:
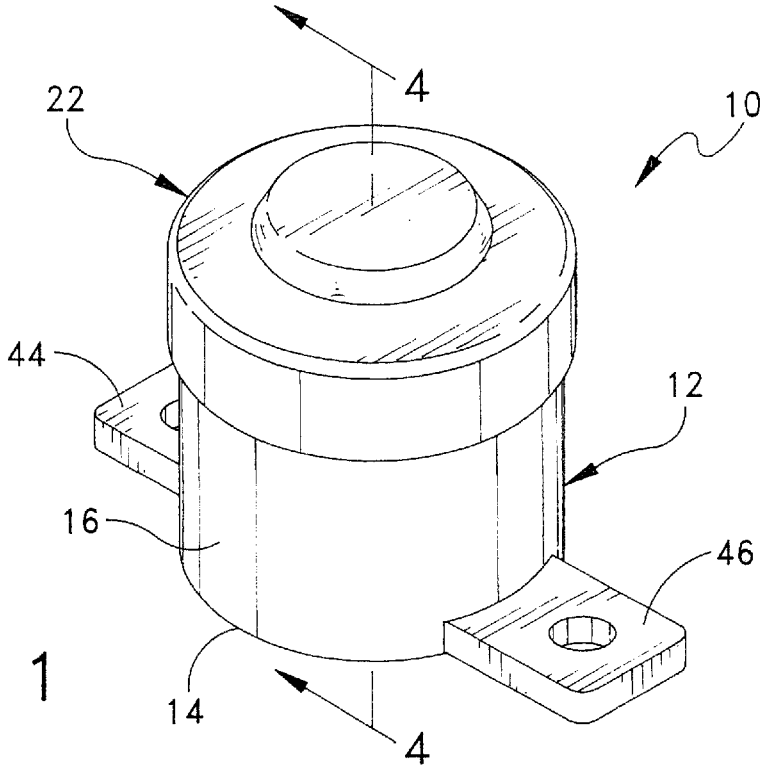
FIG. 1 is a perspective view of a trip free, manual reset thermostat of the present invention.
Figure 2:
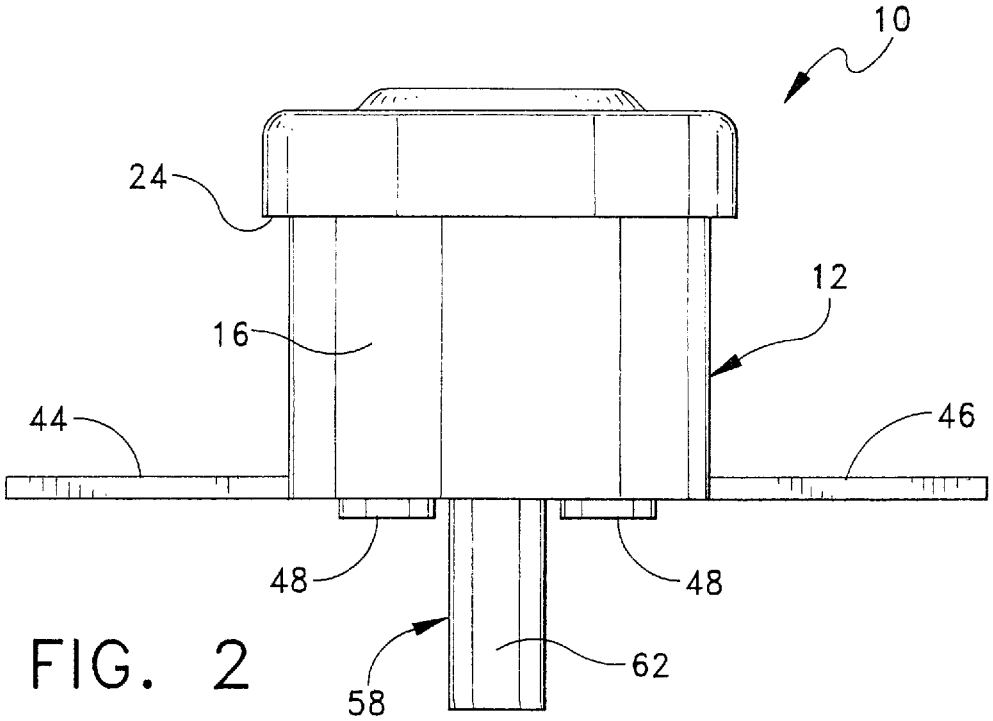
FIG. 2 is an elevational view of the thermostat illustrated in FIG. 1.
Figure 3:
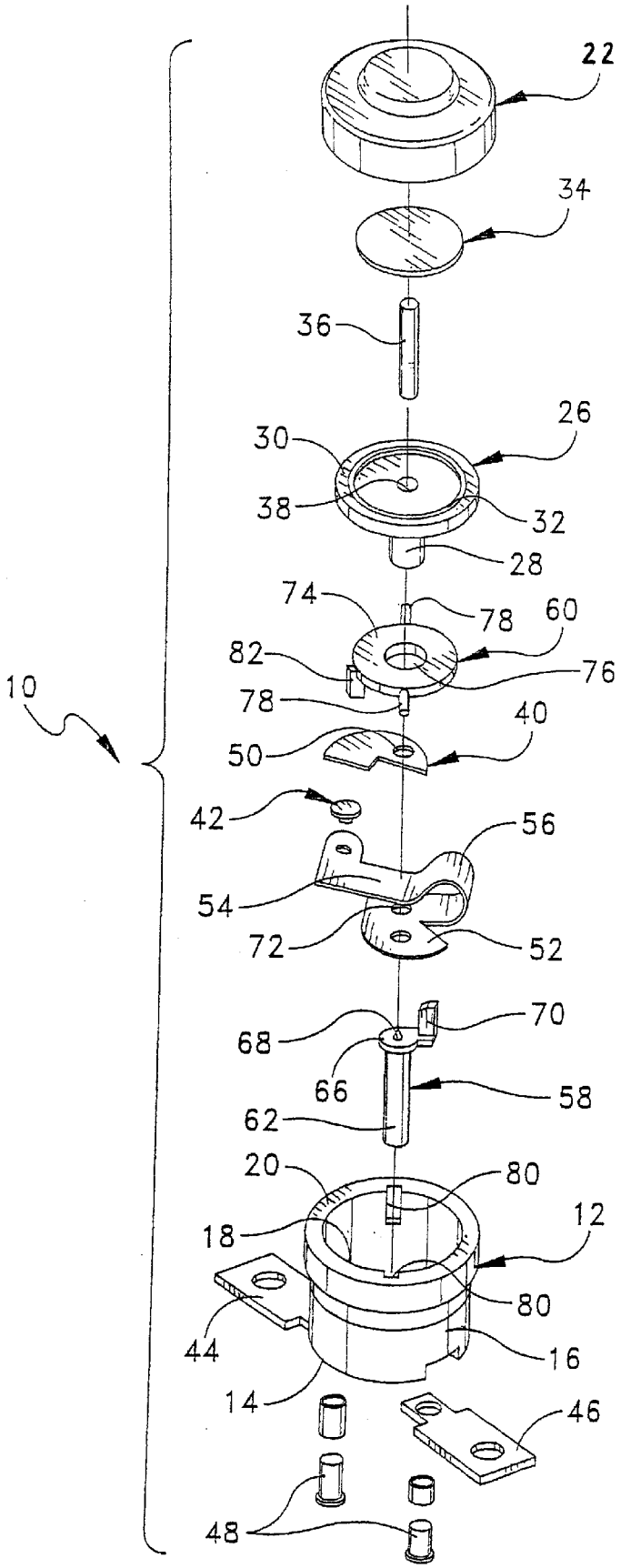
FIG. 3 is an exploded perspective view of the thermostat illustrated in FIGS. 1 and 2.

Referring to the drawings, and to FIGS. 1–3 in particular, there is generally indicated at 10 a trip free, manual reset thermostat of the present invention which is utilized in small electric and gas appliances, such as cooking units, coffee percolators, and the like. As shown, the thermostat 10 comprises a cylindrical housing, generally indicated at 12, having a base portion 14 and an annular wall 16 that is integrally formed with the base portion 14. The base portion 14 and annular wall 16 of the housing 12 define an internal cavity 18 which receives the operable components of the thermostat. The housing 12 is preferably fabricated from suitable insulating or dielectric material of the type conventionally used in thermostat manufacture, such as plastic or ceramic material.

An upper edge margin 20 of the annular wall 16 of the housing 12 is flared outwardly so that an end cap, generally designated at 22, is crimped at 24 to the outwardly flared lower edge margin 20 of the wall 16 to close the open end of the housing 12. The end cap 22 is preferably fabricated from any suitable thermally conductive material, such as aluminum or steel. The end cap 22 is provided for securing a pin guide, generally indicated at 26, therein and for maintaining the pin guide 26 and housing 12 in assembled relation. The pin guide 26 comprises a reduced diameter portion 28 which extends within the cavity 18 of the housing 12 and an increased diameter portion 30 which fits within the end cap 22.

Figure 4:
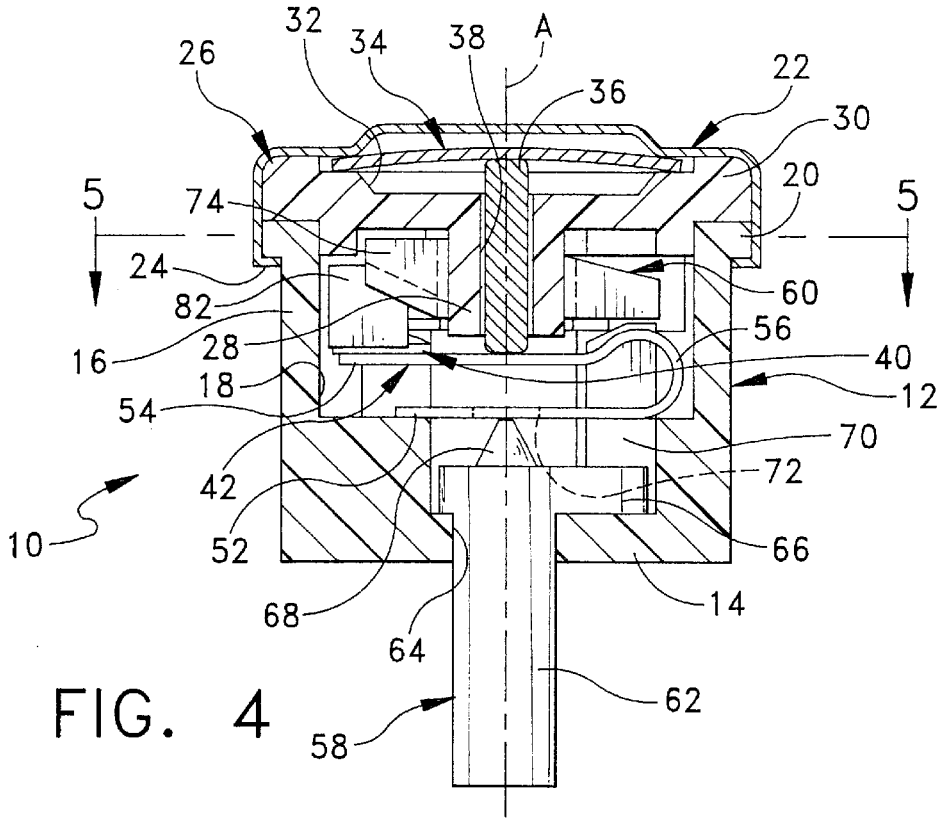
FIG. 4 is a cross-sectional view of the thermostat taken along line 4—4 of FIG. 1 illustrating the thermostat in a switch-closed position.

As illustrated in FIGS. 3 and 4, the upwardly facing surface of the pin guide 26 has a recessed area 32 for receiving a temperature responsive bimetallic disc, generally indicated at 34, therein. The disc 34 is captured within the recessed area 32 by the cap 22, and is, under normal operating temperatures, flexed upwardly as illustrated in FIG. 4. Such discs are well-known in the art of thermostatic switches, and are adapted to flex in an opposite direction in response to temperature changes of the environment in which they are placed. Thus, the disc 34 illustrated in FIG. 4 is adapted to flex downwardly when the temperature in the environment in which the thermostat 10 is placed reaches a predetermined temperature. As shown, the disc 34 engages an actuating member or pin 36 located in an axial bore 38 formed in the pin guide along a vertical axis A. The upper end of the pin 36 axially engages the disc 34 and is moved linearly downwardly upon the disc 34 flexing when the temperature reaches or exceeds the predetermined temperature.

Provided within the cavity 18 of the housing 12 are stationary and movable contact members, designated generally at 40, 42, respectively. These contact members 40, 42 are in electrical communication with first and second terminals 44, 46, respectively, which are mounted on the base portion 14 of the housing 12 by rivets 48 which extend through bores (not shown) formed in the base portion 14 of the housing 12. As shown, the first and second terminals 44, 46 extend outwardly from and are external to the housing 12. The stationary and movable contact members 40, 42 and the first and second terminals 44, 46 are fabricated from any suitable conductive material, such as copper, beryllium copper, and the like, which is capable of handling high electric loads.

As best illustrated in FIGS. 3 and 4, the stationary contact member 40 is generally partially disc-shaped with an opening 50 formed therein for receiving the rivet 48 used to connect the first terminal 44 to the housing 12. The bore (not shown) formed in the base portion 14 of the housing 12 receives the rivet 48 therein for electrically connecting the stationary contact member 40 to the first terminal 44.

The movable contact member 42 is located in the cavity 18 of the housing 12 adjacent the stationary contact member 40. As best shown in FIGS. 3 and 4, the movable contact member 42 includes a generally U-shaped arm having two arm portions 52, 54. The first arm portion 52 is secured to the base portion 14 within the cavity 18 of the housing 12 by the rivet 48 used to attach the second terminal 46 to the housing 12. The arrangement is such that the rivet 48 extends through the bore (not shown) in the base portion 14 to interconnect the second terminal 46 to the movable contact member 42 thereby providing electrical communication between the second terminal 46 and the movable contact member 42. The second arm portion 54 is attached to the first arm portion 52 by a bend portion 56, the bend portion 56 providing a spring-biased force to the second arm portion 54 and the movable contact member 42 so as to ensure the engagement of the movable contact member 42 with the stationary contact member 40.

During operation of the thermostat 10, under normal operational conditions where the temperature of the environment in which the thermostat 10 is placed is below a predetermined level, for example, the thermostat 10 assumes the switch-closed configuration illustrated in FIG. 4. It should be noted that the thermostat 10 can be configured to be biased in the switch-open position if desired. As shown, the stationary contact member 40 is in contact with the movable contact member 42 thereby providing electrical communication between the first and second terminals 44, 46 for completing the circuit. When the temperature in the environment reaches or exceeds the predetermined temperature, the bimetallic disc 34 flexes from the configuration of FIG. 4 to the configuration illustrated in FIG. 6. In this position, the concave surface of the disc 34faces upwardly wherein the interior region of the disc 34 flexes downwardly. The flexing action of the bimetallic disc 34 causes the pin 36 to move linearly downwardly. The lower end of the pin 36 engages the second arm portion 54 of the arm to move the second arm portion 54 towards the first arm portion 52. This motion of the second arm portion 54moves the movable contact member 42 away from the stationary contact member 40 for opening the circuit and prohibiting electrical communication between the first and second terminals 44, 46.

The movable contact member 42 is maintained in its switch-open position until it is manually reset. For achieving this function, a reset assembly is provided. More specifically, the reset assembly comprises a reset element, generally indicated at 58, and a rocker element, generally indicated at 60. The reset element 58 includes a cylindrical part 62 which extends through a bore 64 formed in the base portion 14 of the housing 12 and a flange 66 provided on the upper end of the cylindrical part 62. This flange 66 captures the reset element 58 in the bore 64 and prevents the element 58 from falling out of the housing 12. The reset element 58 further includes a conically-shaped formation 68 formed coaxially on the cylindrical part 62 at its upper end, and a protrusion part 70 extending upwardly from the flange 66. It should be understood that the formation 68 and part 62 can take on any shape in addition to the shown conical and rectangular shapes, respectively. The formation 68 extends through an opening 72 formed in the first arm portion 52 of the arm upon moving the reset element 58 upwardly (see FIG. 7). As shown in FIG. 3, the protrusion part 70 is off-set with respect to the formation 68.

Figure 5:
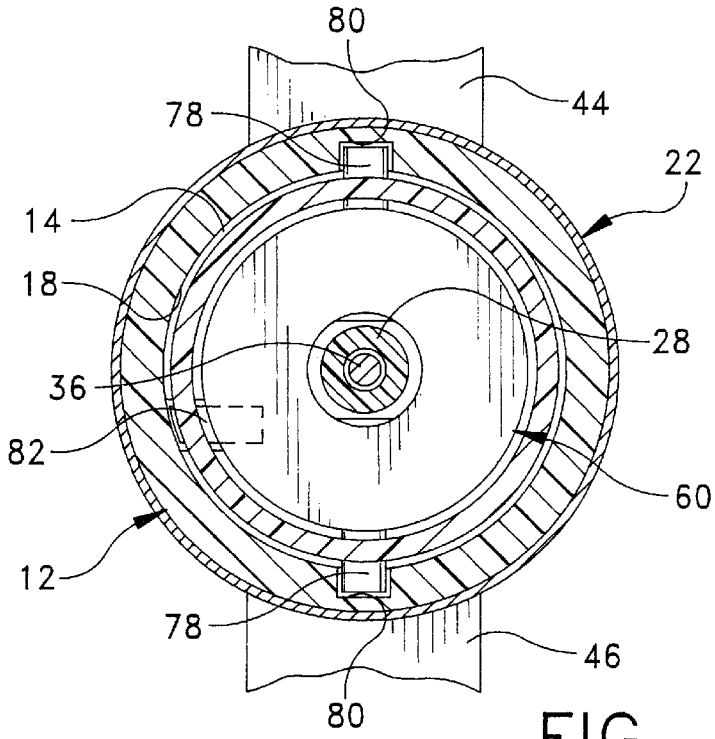
FIG. 5 is a cross-sectional view taken along line 5—5 of FIG. 4.
Figure 7:
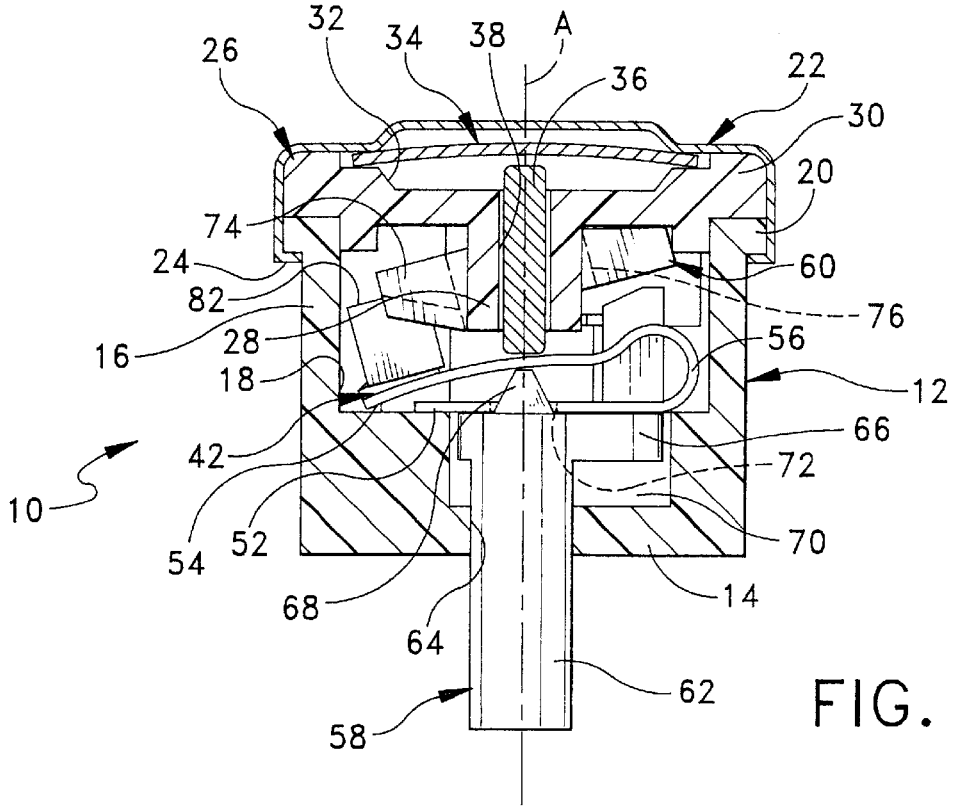
FIG. 7 is a view similar to FIG. 6 with a reset button of the thermostat being depressed.

The rocker element 60 includes an annular body 74 having a centrally located opening 76 formed therein. The body 74 of the rocker element 60 is received over the reduced diameter portion 28 of the pin guide 26 when assembling the thermostat 10. The rocker element 60 further includes a pair of oppositely projecting pins, each indicated at 78, which are integrally formed with the body 74. These pins 78 are received in oppositely positioned grooves or channels 80 formed in the annular wall 16 of the housing 12 (see FIG. 5) in a direction parallel to the direction of the pin 36 and the cylindrical part 62 of the reset element 58. In addition, the rocker element 60 is provided with an downwardly projecting extension 82 which engages the second arm portion 54 of the arm when assembled. The arrangement is such that the body 74 of the rocker element 60 rotates about the pins 78 when the protrusion part 70 of the reset element 58 applies an engaging force thereon as depicted in FIG. 7. The body 74 of the rocker element 60 is shaped so that it can rotate about the pins 78, thereby rotating the extension 82 of the rocker element 60 downwardly. This results in the extension 82 engaging the second arm portion 54 of the arm thereby disengaging the movable contact member 42 from the stationary contact member 40 and achieving the switch-open position.

Figure 6:
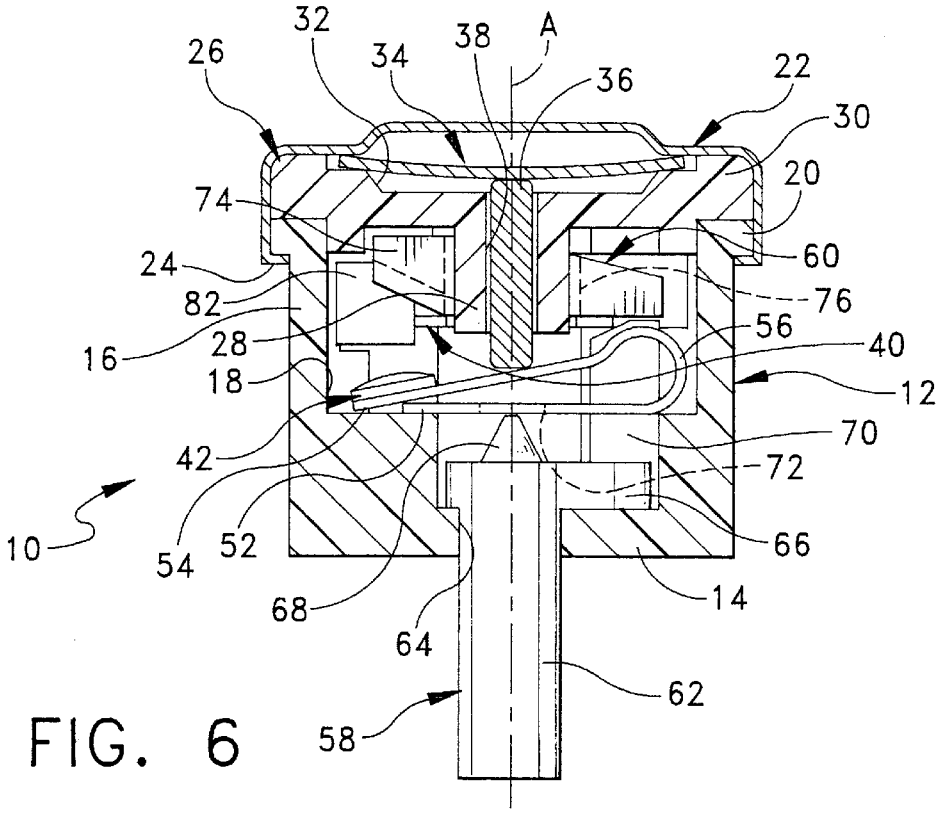
FIG. 6 is a cross-sectional view similar to FIG. 4 illustrating the thermostat in a switch-open position.

Turning now to FIGS. 4 and 6–8, the operation of the reset assembly of the thermostat 10 is as follows. As illustrated in FIG. 4, the thermostat 10 is in its switch-closed position. More specifically, the bimetallic disc 34 is in its normal, pre-flexed condition and the movable contact member 42 is engaging the stationary contact member 40. Upon being subjected to a temperature exceeding the predetermined temperature of the disc 34, the disc 34 flexes downwardly thereby moving the pin 36 downwardly which in turn engages the second arm portion 54 for disengaging the movable contact member 42 from the stationary contact member 40. This switch-open position is illustrated in FIG. 6.

To reset the thermostat 10 after the temperature falls back below the predetermined temperature of the disc 34, the cylindrical part 62 of the reset element 58 is manually moved from a first position illustrated in FIGS. 4 and 6 upwardly to a second position depicted in FIG. 7. This motion results in the protrusion part 70 engaging the underside of body 74 of the rocker element 60. This motion also results in the formation 68 engaging the second arm portion 54 of the arm which in turn engages the pin 36 for moving the pin upwardly. The pin 36 then forces the disc 34 back to its pre-flexed condition as shown in FIG. 7. Meanwhile, the protrusion part 70 of the reset element 58 engages the body 74 of the rocker element 60 to rotate the rocker element 60 counterclockwise about the pins 78. This effects the engagement of the extension 82 with the second arm portion 54 of the arm thereby maintaining the movable contact member 42 in its switch-open position.

Figure 8:
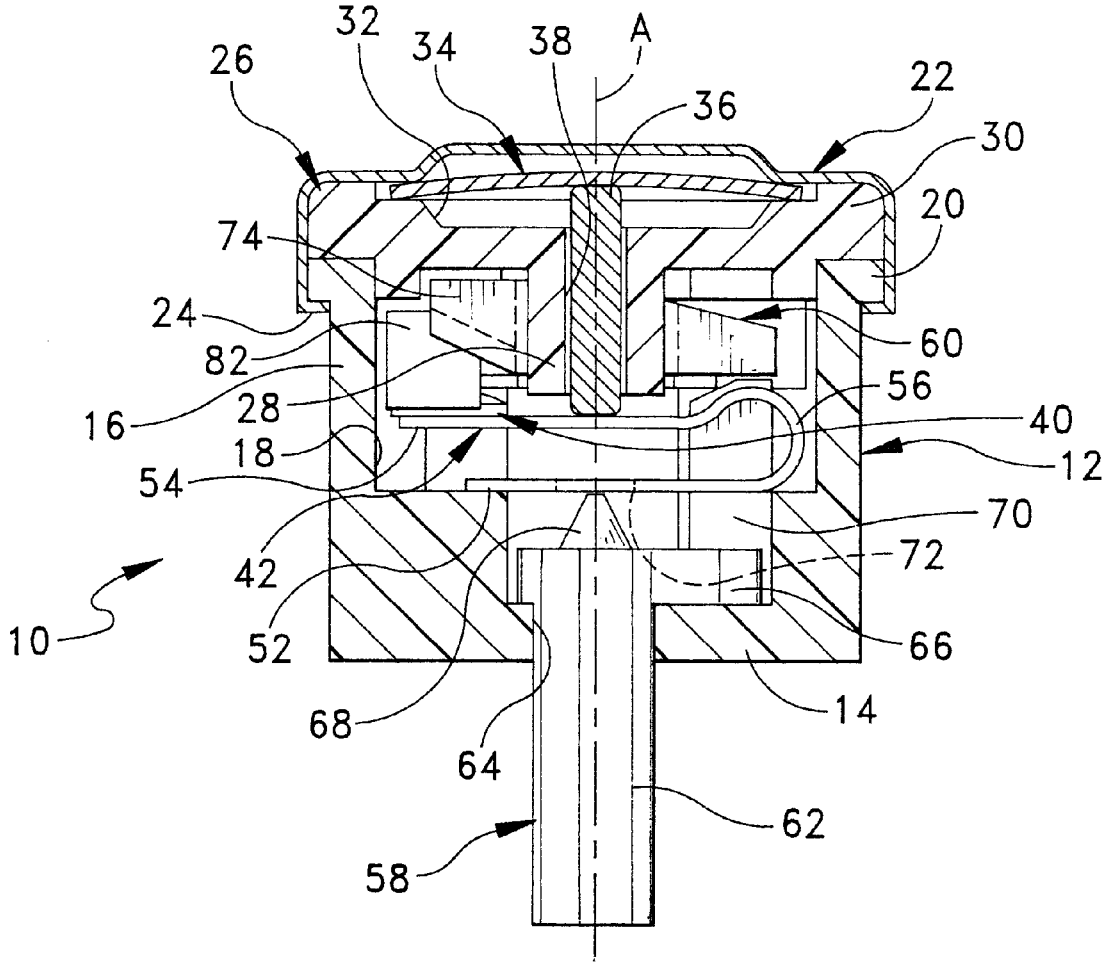
FIG. 8 is a cross-sectional view of the thermostat identical to FIG. 4.

Only after the upward force manually applied on the cylindrical part 62 of the reset element 58 is removed, and the reset element 58 returns to its first position illustrated in FIGS. 4 and 6, can the spring biased second arm portion 54 of the arm of the movable contact member 42 resume its engagement with the stationary contact member 40. This position is illustrated in FIG. 8. However, it should be noted that if the temperature is still above the predetermined temperature, the bimetallic disc 34 will flex downwardly when the force applied by the pin 36 is removed (i.e., by the reset element 58 moving back to its first position). This results in the pin 36 moving downwardly by the flexing action of the disc 34 which disengages the stationary and movable contact members 40, 42.

Thus, it should be observed that the thermostat 10 of the present invention can only be reset when the temperature is below the predetermined temperature of the disc 34. At no time during the resetting process, is the movable contact member 42 brought into contact with the stationary contact member 40. This is achieved by the interaction of the reset element 58 with the rocker element 60 and the rocker element 60 with the second arm portion 54 of the arm of the movable contact member 42.

It should be further observed that the thermostat 10 with trip free, manual reset of the present invention comprises a minimal number of component parts by virtue of the movable second arm portion 54 engaging the rocker element 60 for maintaining the arm portion 54 away from the stationary contact 40. This decreases the cost of the thermostat's manufacture over those of the prior art since there is a fewer number of component parts. It can therefore be seen that the instant invention provides an advantage over the prior art.

For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A thermostat comprising:

a housing having a cavity formed therein;

a temperature responsive bimetallic disc located in the housing and being responsive to a predetermined temperature for exerting a flexing action;

a stationary contact member located in the cavity of the housing and being electrically interconnected to a first terminal external to the housing;

a movable contact member located in the cavity of the housing adjacent the stationary contact member, said movable contact member being electrically interconnected to a second terminal external to the housing, and being biased and movable between a switch-closed position in which it makes electrical contact with the stationary contact member and a switch-open position in which it is spaced from said stationary contact member;

an actuating member located in the cavity of the housing and being responsive to flexing movement of the disc for moving the movable contact member from said switch-closed position to said switch-open position; and a reset assembly for resetting the disc, the reset assembly comprising:

a reset element which is movable between a first position in which it is spaced from the actuating member and a second position in which it is axially moved to engage the actuating member for moving the disc back to its pre-flexed position, said reset element comprising a cylindrical part which extends through an opening formed in the housing in a direction coaxial with the direction of the actuating member, and a protrusion part extending from the cylindrical part; and a rocker element engageable with the movable contact member for maintaining the movable contact member in its switch-open position while the reset element is in its second position, said rocker element comprising a body engageable with the protrusion part of the reset element and the movable contact member, and means associated with the body for pivotally engaging the housing, wherein upon moving the reset element to its second position, the protrusion part of the reset element engages the body of the rocker element thereby rotating the body about said pivoting means for moving the movable contact member away from the stationary contact member.

2. A thermostat as set forth in claim 3, said body of the rocker element having a projection in engagement with the movable contact member.

3. A thermostat as set forth in claim 1, said pivoting means comprising a pair of oppositely projecting pins which extend outwardly from the body, said pins being received in oppositely positioned grooves formed in the housing.

4. A thermostat as set forth in claim 3, further comprising an arm having two arm portions, one arm portion having the movable contact mounted thereon and the other arm portion having an opening formed therein for receiving the cylindrical part of the reset element therethrough.

5. A thermostat as set forth in claim 4, said cylindrical part of the reset element having a formation provided thereon, said formation extending through an opening of said other arm portion and engaging said one arm portion for moving the actuating member to its switch-closed position.

6. A thermostat as set forth in claim 1, said actuating member comprising a pin located in said housing, said pin having one end which axially engages said bimetallic disc and an opposite end which axially engages said movable contact member, said flexing movement of the disc moving said pin in a longitudinal direction for urging said movable contact member out of engagement with the stationary contact member and into its switch-closed position.

* * * * *